United States Patent [19]

Quaif et al.

[11] 4,020,939

[45] May 3, 1977

[54] MATRIX PRINT HEAD REPETITION RATE CONTROL

[75] Inventors: Richard S. Quaif, Dryden; John D. Hays, Ithaca, both of N.Y.

[73] Assignee: NCR Corporation, Dayton, Ohio

[22] Filed: Oct. 21, 1975

[21] Appl. No.: 624,503

[52] U.S. Cl. ..... 197/1 R; 178/26 R; 178/30; 340/172.5; 197/82

[51] Int. Cl.[2] ..... B41J 3/04

[58] Field of Search ..... 197/1 R, 19, 20, 82; 101/93.04, 93.05; 178/23 R, 24, 23 A, 26 R, 26 A, 30; 340/172.5; 235/61.9 R

[56] References Cited

UNITED STATES PATENTS

| | | | |
|---|---|---|---|
| 3,291,910 | 1/1966 | Nicklas et al. | 178/26 R |
| 3,363,238 | 1/1968 | Clark et al. | 178/23 R |
| 3,376,384 | 4/1968 | Abhramowicz | 178/26 R |
| 3,703,949 | 11/1972 | Howard et al. | 197/1 R |
| 3,719,781 | 3/1973 | Fulton et al. | 178/30 |
| 3,938,641 | 2/1976 | Fulton | 197/1 R |

*Primary Examiner*—Ralph T. Rader
*Attorney, Agent, or Firm*—J. T. Cavender; Wilbert Hawk, Jr.; Jeffrey P. Morris

[57] ABSTRACT

A matrix printer hammer repetition rate control is disclosed for varying the print hammer repetition rate in accordance with printing speed, thereby maintaining constant width of printed characters without dot column sensing. A master clock is counted over each character period to generate a digital code which, after conversion to an analog signal, serves as the control voltage for a voltage controlled oscillator. The VCO output is a variable clock from which the timing for various print heads is derived. Printing data is gated to the hammer drive circuits at a variable rate proportional to the speed of the printing heads across a printing medium.

24 Claims, 35 Drawing Figures

MATRIX PRINT HEAD REPETITION RATE CONTROL

CROSS REFERENCE TO RELATED APPLICATION

MATRIX PRINT HEAD IMPACT ENERGY CONTROL, copending application Ser. No. 624,502, filed on even data herewith, invented by Richard S. Quaif, assigned to NCR Corporation.

BACKGROUND OF THE INVENTION

1. Field of the Invention

The present invention relates generally to the field of matrix printing wherein alphanumeric characters are printed in dot matrix form by the energization of one or a plurality of wire elements or, print hammers, in response to digitally generated character data for driving and controlling one or more printing heads, each head including one or more of such print hammers, for sequentially printing lines of characters on a print receiving medium. The matrix printing field also includes non-impact printing such as thermal printing. More particularly, the present invention relates to a matrix printer and a novel wire matrix print head repetition rate control therefor, for varying the repetition rate of the print hammers in accordance with the speed of printing, or the rate at which the printing head or heads traverse the printing medium, thereby printing characters of constant width and clarity at varying printing speeds. The present invention also relates to the generation of variable digital clocks for clocking printing data and hammer drive pulses to a matrix print head or heads synchronously and at a rate which produces even character column spacing and constant character width regardless of variation in the speed at which characters are printed.

2. Description of the Prior Art

Modern high speed matrix printers must have print head control capable of printing a variety of character fonts at ever increasing and varying speeds, under varying input powder conditions and yet maintain reliability of operation, cost efficiency, durability, uniform character spacing and width and constant print quality. While the actual print head construction does not form a part of the present invention, many configurations are possible, both with respect to the number of print wires and print wire orientations. A typical matrix print head wire matrix drive is illustrated by U.S. Pat. No. 3,690,431. A timing control of the prior art for a matrix printer is illustrated by U.S. Pat. No. 3,719,781. A dual three-station matrix printer of the prior art is illustrated by U.S. Pat. No. 3,825,681.

A digital to analog converter with amplitude and pulse-width modulation, of the prior art, is disclosed by U.S. Pat. No. 3,789,393, wherein pulse-width modulated and pulse-amplitude modulated signals are summed to derive fine data bits and coarse data bits in a position measuring apparatus.

SUMMARY OF THE INVENTION

The invention is directed to a novel matrix print head repetition rate control circuit and the matrix printing character generation and timing logic incorporating the print head repetition rate control circuit. A variable frequency clock is generated, the frequency being variable in accordance with printing speed to maintain constant width characters without dot column sensing. Three phased trigger signals initiate the hammer drives in a multiple head printer for printing at three locations with one, two, or three printing heads. A master clock is generated and counted over a character pulse time period to generate a multiple bit code, such as five bits, which code is converted to an analog signal which is coupled to a voltage controlled oscillator having an output which triggers the gating logic wherein the hammer data is stored, and also from which variable frequency output clock all print head timing is derived.

It is therefore an object of the invention to provide a repetition rate control circuit for varying the rate at which the print hammers of a matrix printer are energized in accordance with the carriage or printing speed of print head as it traverses the printing medium.

It is another object of the invention to generate a variable frequency clock from which the system timing for the control circuitry of a matrix printer is derived for maintaining constant character widths notwithstanding varying printing speeds.

It is another object of the invention to provide improved repetition rate control for a multiple head matrix printer.

The foregoing and other features and advantages of the invention will become apparent from the following detailed description of a preferred embodiment of the invention together with the accompanying drawings.

DESCRIPTION OF THE PREFERRED EMBODIMENT

Figure 1:
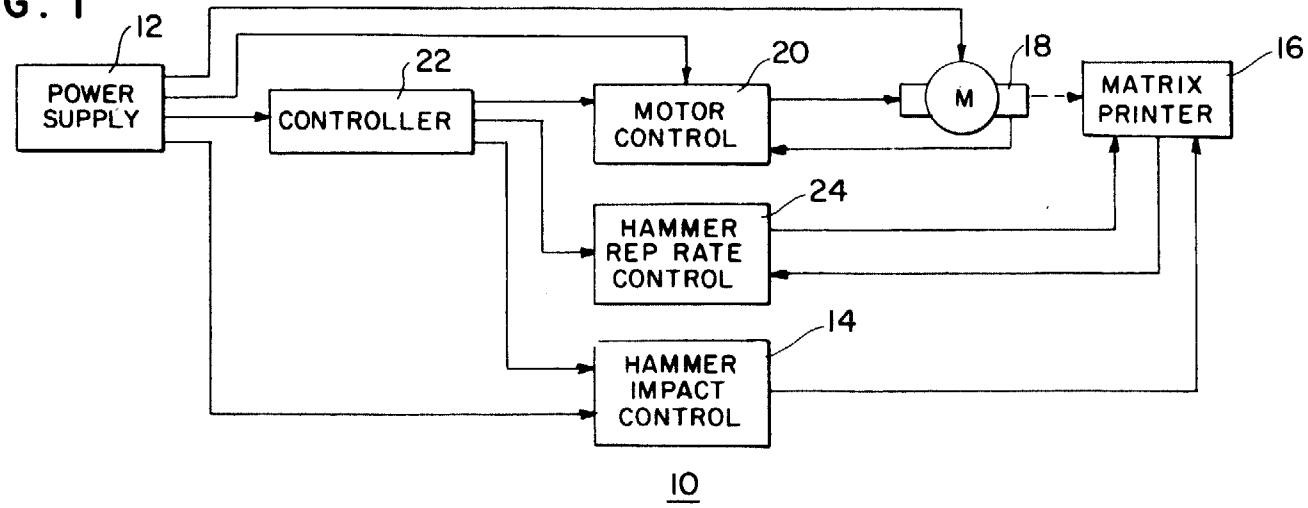
FIG. 1 is a simplified block diagram of a matrix printer control embodying the hammer repetition rate and impact energy control of the present invention.

Referring now to FIG. 1, a simplified block diagram of the control circuitry for a matrix printer having a multiple or a single printing head capability, is illustrated generally at 10. As previously mentioned, it is desirable in matrix printing to maintain a substantially constant print wire impact energy as the print head containing the print wires traverses the printing media during printing of alphanumeric characters at varying speeds and under varying input powder conditions resultant, for example, from variations in the input power supply 12 output voltage. A novel hammer impact energy control circuit 14, described in detail with respect to FIG. 3, controls the hammer drive pulse width in accordance with power supply variation and, when necessary, provides sufficient energy for printing multiple copy forms with one or more printing heads.

An exemplary matrix printer having a control therefor in accordance with the present invention is matrix printer 16, being a serial impact three-station printer utilizing two seven-wire print heads for generating dot matrix character fonts having an NX7 dot configuration. As is well known, the two print heads are utilized to print at slip, journal and receipt stations. In the alternative, a single printing head could serially print at the three stations or three heads could be used, one for each station. The control circuitry of the present invention is equally applicable to any of the above printer head configurations. The carriage upon which the print heads are mounted is driven by a reversible dc motor 18 under the control of motor control 20 for accelerating motor 18 up to print velocity and for maintaining a substantially constant velocity during printing. Motor control 20 varies the speed of dc motor 18 by means of a dual feedback from the driven carriage and from power supply 12 to maintain constant motor speed during power supply variations, without conventional regulation circuitry. The output of a one shot multivibrator, a function of motor speed, is summed in a summing integrator with the power supply feedback signal to derive a motor control signal which is applied to a pulse width modulator, the output of which is the motor drive. Thus, the feedback one-shot multivibrator output serves as the time standard for comparison with the motor feedback. High motor speed causes the one-shot to have a high average output and slow motor speed causes a low average output from the one-shot, which operates as a simple tachometer. The above simplified motor control 20 is described by way of example only, as other known motor controls may be utilized in conjunction with the present invention, and therefore, the motor control per se does not form a part of the present invention.

The print head impact energy is maintained substantially constant during printing by the novel hammer impact control circuitry 14 of the present invention. The print head energy, in the form of electrical pulses, is applied to the individual matrix wire solenoid drivers in the print head, and is maintained constant notwithstanding variations in the output voltage or current of power supply 12. The hammer impact energy control circuitry 14 is described more particularly with reference to FIG. 3; however, generally, this circuitry consists of a summing amplifier which adds the power supply 12 output with increasing pulse width inputs and which has an output applied to a pulse width modulator. The pulse width modulator, in response to the summing amplifier output, generates control pulses modulated with the correct control pulse widths and synchronized by a synchronization signal supplied from the printer controller 22, and derived from a variable frequency clock.

The print hammer repetition rate control 24 varies the repetition rate of each of the print wire solenoid drivers in each of the printing heads of matrix printer 16 such that the width of the printed alphanumeric characters is maintained substantially constant. The character pattern and sequence is controlled by character data from controller 22 and its associated memory, while clocking pulses are counted by the repetition rate control 24 over a character pulse time period, which varies in accordance with the desired printing speed, i.e., short for high speed and long for low-speed and converted into a digital code representative of the character repetition frequency. The digital code is converted to an analog control signal which serves as the voltage control for a voltage controlled oscillator, the variable frequency output of which VCO is gated to the control 24 and to the print head data output gating registers for loading of character data therein at a hammer repetition rate proportioned to the carriage speed, which, as previously mentioned, is determined by the speed of motor 18, and in synchronism with the pulse width modulated hammer drive output.

Figure 2:
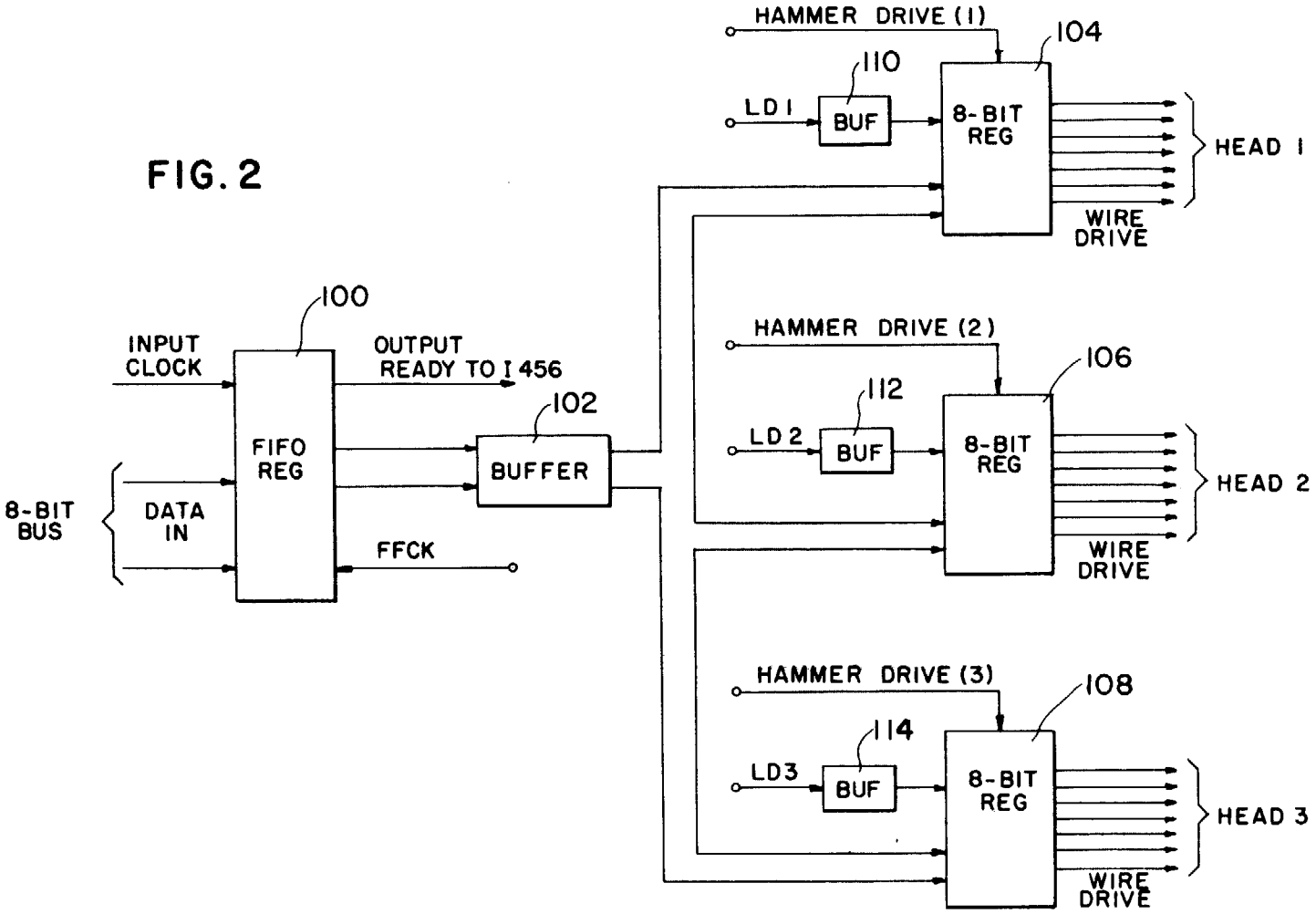
FIG. 2 is a block diagram of a logic interface for coupling hammer firing data from a controller to a matrix printer.

Referring now to FIG. 2, the circuitry for coupling hammer selection data from the controller 22 to the print wire drive solenoids of the print heads is illustrated. Each wire may be independently energized by logical "1" outputs of the eight-bit output latching registers associated with each hand. Thus, energization of hammers one through seven of head 1, for example, permits printing an NX7 matrix front, where N is any integer, and at a repetition rate for the illustrated circuitry of 1.3 milliseconds.

Hammer firing data for character generation is coupled to a first-in-first-out (FIFO) shift register 100 via an eight-bit wide parallel data bus from the controller data storage, clocked by an input clock which indicates that data on the control bus is valid and for the FIFO 100. The FFCK clock is an output clock being used by the FIFO register to clock new data to the output of register 100, through suitable output buffer gates 102 to the eight-bit latching output register 104 for head 1, register 106 for head 2 and register 108 for head 3. The individual print wire drivers are darlington amplifiers supplied with base current by registers 104, 106 and 108. CMOS non-inverting buffer 110, clocks register 104 of head 1 with data from output buffer 102, buffer 112 loads register 106 of head 2 with data from output buffer 102 and buffer 114 loads register 108 of head 3 with data from output buffer 102. Load signals LD1, LD2 and LD3, derived by division of the variable clock, and clock data through buffers 110 through 114 respectively, which data selectively enables the three generated hammer drive signals for the printing heads (hammer drives 1, 2 and 3) described in detail with respect to FIG. 3 from hammer impact control circuit 14 to registers 104, 106 and 108, respectively. The OUTPUT READY signal from FIFO register 100, utilized by the system timing, indicates that valid data exists on the FIFO outputs. Each of the seven wire drive outputs for each of registers 104, 106 and 108 fires the print wires for a time duration determined by the respective hammer drives having pulse widths variable in accordance with power supply variations.

Figure 3:
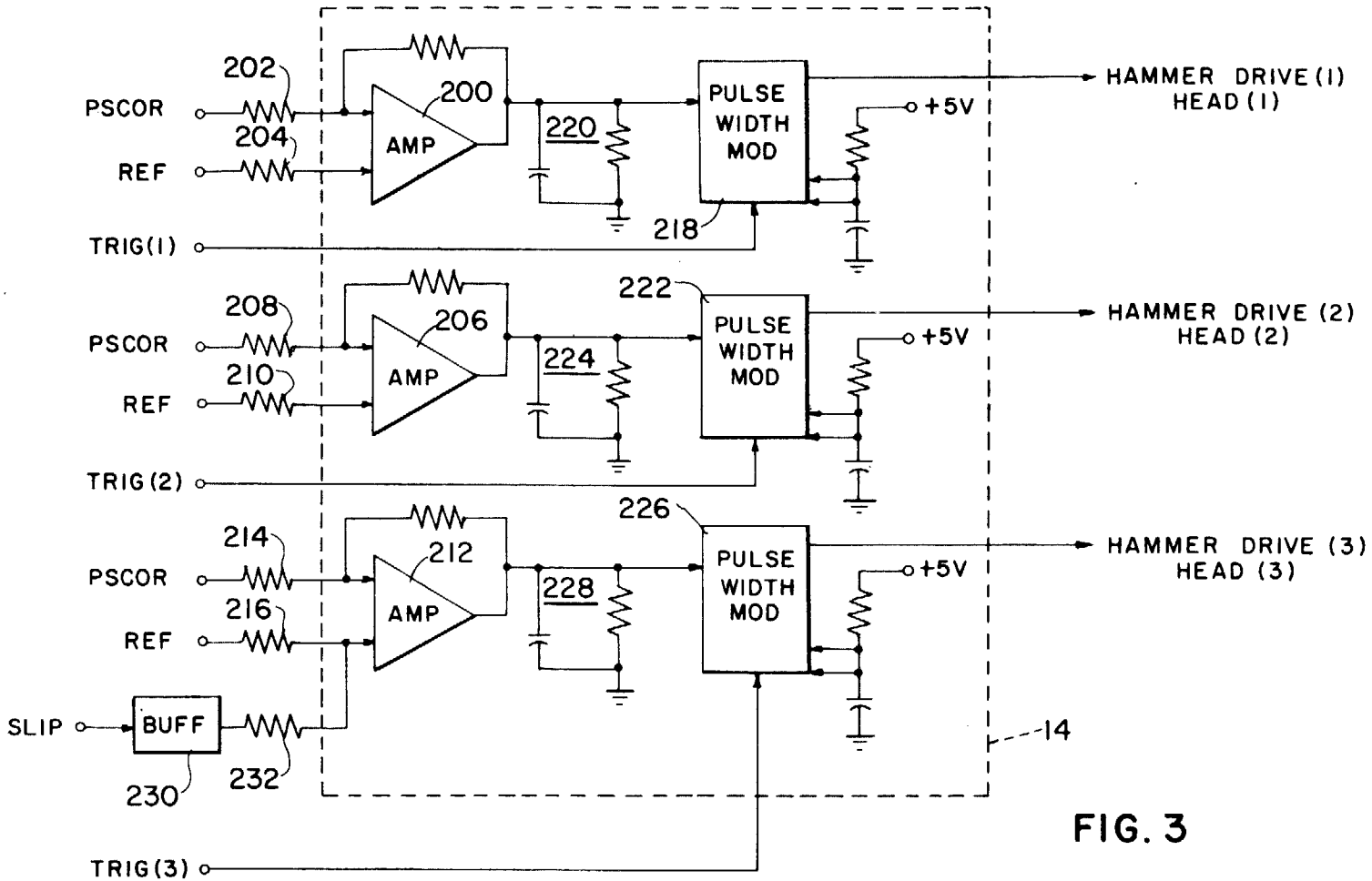
FIG. 3 is a block and schematic diagram of a hammer impact energy control circuit in accordance with the present invention.

Referring now to FIG. 3, the hammer impact energy control 14 is illustrated, which control adjusts the print wire energization hammer drives for the print heads to compensate for power supply variation by generating variable pulse width outputs. A summing amplifier 200, preferably an operational amplifier (such as LM3900 of National Semiconductor) has coupled thereto across input resistance 202 a power supply correction signal (PSCOR) derived by sampling the output voltage of power supply 12. A reference voltage (REF) is summed with the power supply correction signal by the amplifier 200 as a bias supply, and is coupled thereto across input resistor 204. The same correction signal and reference voltage are summed by operational amplifier 206 for head (2) across input resistances 208 and 210 and by operational amplifier 212 for head (3)

across input resistances 214 and 216. PSCOR is derived for a power supply output voltage of +28 volts +10–15 percent while REF is derived from +12 volts + 10 percent for a typical power supply.

Pulse width modulator 218 has coupled to the input thereof the output from amplifier 200 after filtering by a filter network 220 and a synchronization signal (TRIG 1) for initiating the modulator 218 output pulses for hammer drive (1). Typically, the output of modulator 218 will be equal to 15.73 (28–V) +420 microseconds ± 2 microseconds, where V equals, PSCOR (ideally, 28 volts). The hammer drives (2) and (3) are derived in the same manner as is hammer drive (1), with pulse width modulator 222 having coupled thereto the output of summing amplifier 206 after filtering by filter network 224 and with pulse width modulator 226 having the output of summing amplifier 212 coupled thereto after filtering by filter network 228. The leading edge of the hammer drive (2) of modulator 222 is triggered by TRIG (2) while the leading edge of hammer drive (3), for head (3), the slip station of the matrix printer, is triggered by the TRIG (3). The head (3) hammer drive summing amplifier 212 may include additional slip width correction via the SLIP voltage input to buffer 230, the output voltage of which buffer is coupled across resistor 232 to the amplifier 212 to provide additional drive for printing multiple copy forms. Pulse width modulators 218, 222 and 226 may comprise, for example, model 555 timer circuits manufactured by Signetics and operable in a monostable mode to be triggered with a continuous pulse train. TRIG (1), (2) and (3) are variable frequency pulses, as they are phased signals derived by division of HCK, as explained with reference to FIG. 8.

Figure 6:
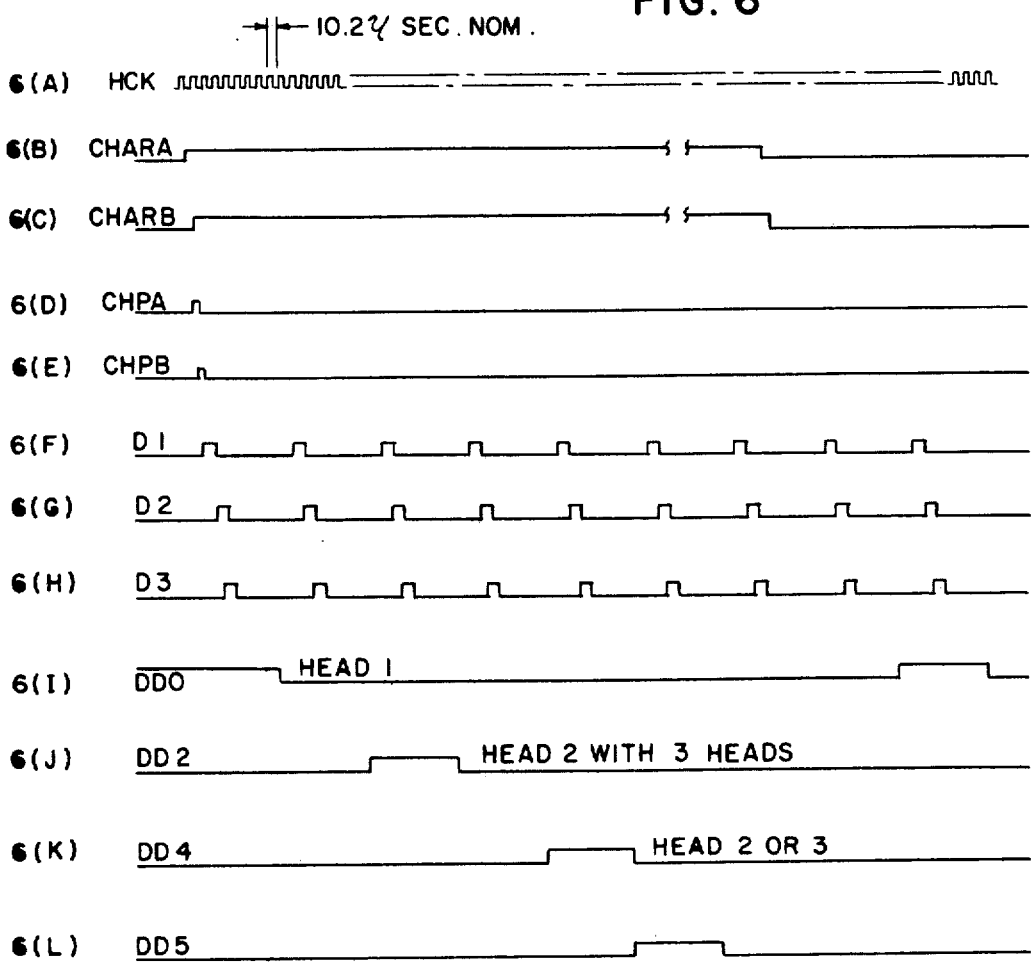
FIGS. 6(A) through 6(L) are various waveforms illustrative of the timing and operation of the present invention.
Figure 7:
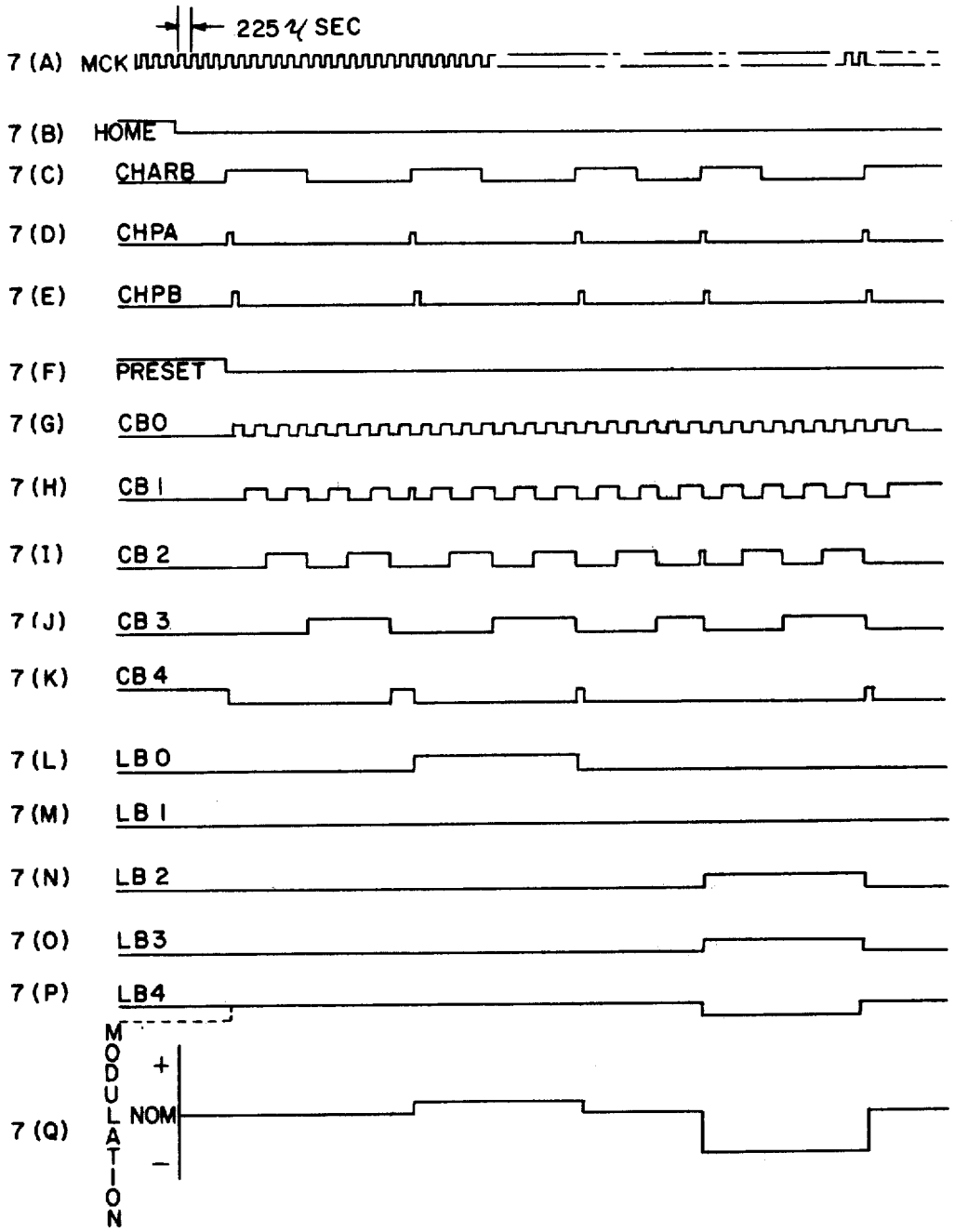
FIGS. 7(A) through 7(Q) are further various waveforms illustrative of the timing and operation of the present invention.

The hammer repetition rate control 24 illustrated in block diagram by FIG. 4 and schematically by FIG. 5, together with the hammer control timing circuitry of FIG. 8 will now be described. The waveforms illustrated by FIGS. 6 and 7 appear at various points in the description of the schematics of FIGS. 5 and 8, and are defined as follows:

| | | |
|---|---|---|
| 6(A) | HCK | A variable hammer clock of approximately 10.2 microseconds used in deriving all print head timing. |
| 6(B) | CHAR A | derived from input character pulses and synchronized with HCK. |
| 6(C) | CHAR B | derived from input character pulses and synchronized with HCK. |
| 6(D) | CHPA | derived from CHAR B and used to load latch 306. |
| 6(E) | CHPB | derived from CHPA and used to reset counter 304. |
| 6(F) | $D_1$ | first decoded count of HCK decoded by decoder 460. |
| 6(G) | $D_2$ | second decoded count of HCK decoded by decoder 460. |
| 6(H) | $D_3$ | third decoded count of HCK decoded by decoder 460. |
| 6(I) | DDO | first decoded counts of HCK ÷ 8 |
| 6(J) | DD2 | third decoded counts of HCK ÷ 8 |
| 6(K) | DD4 | fifth decoded counts of HCK ÷ 8 |
| 6(L) | DD5 | sixth decoded counts HCK ÷ 8 |
| 7(A) | MCK | a reference frequency of 225 microsec. for comparison with the character pulses. |
| 7(B) | HOME | A loading signal for preloading latch 420 and derived by OR'ing HOME A, B and C of the print head (home positions at each station). |
| 7(C) | CHAR B | same as 6(C) |
| 7(D) | CHP A | same as 6(D) |
| 7(E) | CHP B | same as (E) |
| 7(F) | PRESET | used to preset the count of counter 304 and to disable MCK. |
| 7(G) | CBO | output of counter 418 |
| 7(H) | CB1 | output of counter 418 |
| 7(I) | CB2 | output of counter 418 |
| 7(J) | CB3 | output of counter 418 |
| 7(K) | CB4 | output of counter 418 |
| 7(L) | LB0 | output of latch 420 |
| 7(M) | LB1 | output of latch 420 |
| 7(N) | LB2 | output of latch 420 |
| 7(O) | LB3 | output of latch 420 |
| 7(P) | LB4 | output of latch 420 |
| 7(Q) | MODULATION | the output of VCO 312. |

Figure 4:
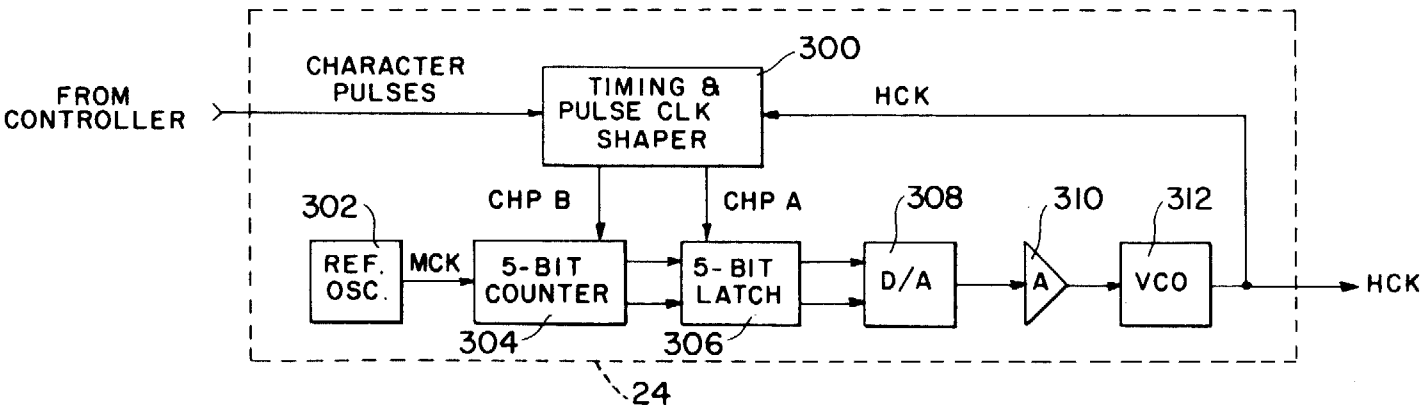
FIG. 4 is a block diagram of a hammer repetition rate control for varying the hammer firing rate with printing speed in accordance with the present invention.

Referring now to FIG. 4, a novel print hammer repetition rate control is illustrated, in which the hammer repetition rate is varied proportionally to the speed at which the print head is incremented across the printing medium to produce constant width printed characters at varying printing speeds. Clock pulses are counted over each character pulse time period having a pulse repetition frequency corresponding to the time period of the characters, the input data signal generating a digital code which is converted to an analog voltage for controlling a voltage controlled oscillator, the output of which VCO is a variable frequency clock proportional to the printing speed.

Character pulses from the controller 22 are coupled to a pulse shaping circuit 300 which functions as a digital filter and synchronizes a pulsed output representative of the character time duration with HCK to produce two clock pulses, CHPA and CHPB illustrated by FIGS. 6(D) and 6(E) which two clock pulses are synchronized with the leading edge of the incoming character pulses. A free-running oscillator, reference oscillator 302 having a period of 225 microseconds, or any frequency substantially greater than the character pulse repetition frequency, is used for generating 7×7 character fonts or, alternatively, a 227 microsecond period for generating 5×7 character fonts, the reference frequency or master clock (MCK) illustrated by FIG. 7(A). A five-bit counter 304, present to HOME (the initial print head position) counts to 16 during a character pulse period, after which the counter 304 is cleared by the character print pulse B (CHP B) clock derived by pulse shaper and digital filter 300, with clearing of counter 304 occurring after the output of counter 304 is loaded into a five-bit latch 306 with character print pulse A (CHP A) from shaping circuit 300. The five-bit latch 306, loaded by CHP A, stores the count for the digital to analog converter 308, a resistive ladder circuit for generating 32 different analog outputs corresponding to the five-bit input thereto from latch 306. The analog voltage output from digital to analog converter 308 is amplified by the VCO driver circuit, a buffer operational amplifier 310 which produces the proper gain for voltage controlled oscillator 312. The VCO 312 output, HCK, illustrated by FIG. 6A, is normally approximately 10.2 microseconds which, when divided by 64 produces a 650 microsecond nominal hammer repetition rate. Typically, VCO 312 is TTL logic, however, CMOS logic is utilized in D/A 308. The "printing speed" is sometimes referred to as the printer cycle time, which is the time required for the carriage to traverse the print line and return to its home or start position. Obviously, the printer cycle time is data dependent, in that it varies with the number of columns of characters printed and with the number of printing heads.

Figure 5:
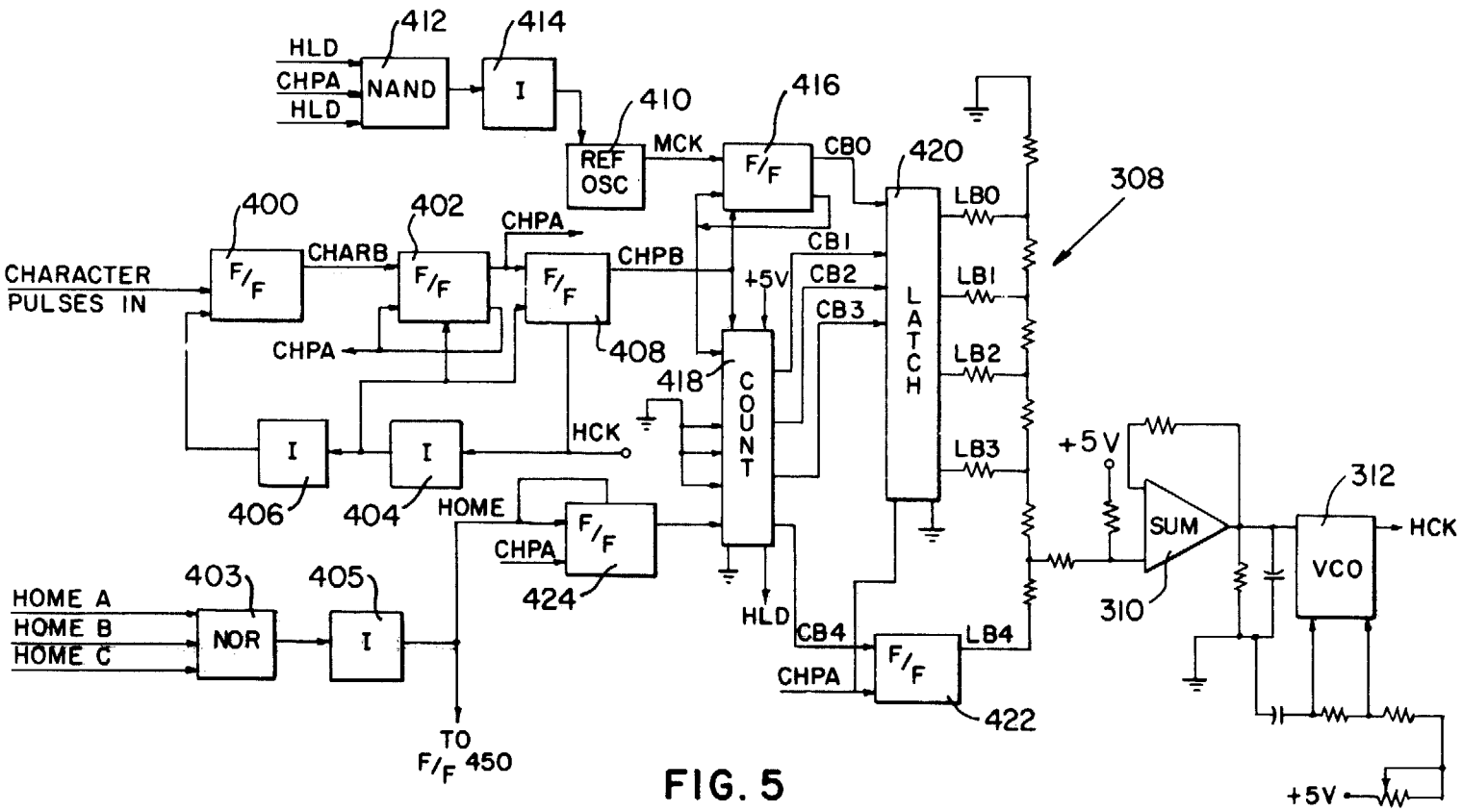
FIG. 5 is a schematic diagram of the hammer repetition rate control described with respect to FIG. 4.

Referring now to FIG. 5, the hammer repetition rate control circuit 24 of FIG. 4 is illustrated in greater detail.

The character pulse shaping circuit 300 is comprised of a pair of D type flip-flops 400 and 402, with flip-flop 400 receiving input character pulses at its data input and having an output of CHARB coupled to the input of flip-flop 402. The variable HCK output of VCO 312, which may comprise a Signetics model 555 timer, is applied to the input of inverter 404, which inverter is coupled to the input of inverter 406 for re-inverting the HCK and utilizing the HCK as the clock input to flip-flop 400 for synchronizing the incoming character pulses. The latch 306 loading signal CHPA illustrated by FIG. 6(D) is derived from the output of flip-flop 402. Signal CHPA is also coupled to the data input of another D type flip-flop 408 from which CHPB illustrated by FIG. 6(E), the counter 304 reset signal is derived. Flip-flop 408 is clocked by the inverted HCK output of inverter 404. Flip-flops 400 and 402, together with inverters 404 and 406, comprise a digital filter circuit.

Reference oscillator 302 (FIG. 4) is comprised of a timer 410 (FIG. 5) for generating the master clock, MCK as described. Reference oscillator timer 410 is gated ON by CHPA from flip-flop 402 applied to one input of a two input NAND gate 412, the other input to NAND gate 412 being a hold signal indicative of counter overflow for stopping the MCK generation. Inverter 414 inverts the output of NAND 412 and couples same to the reference oscillator 410. Oscillator 410 output MCK (225 microsecond for a 7×7 font) clocks counter 304 (FIG. 4) which is comprised of D flip-flop 416 and five-bit counter 418 (FIG. 5) for counting to 16 each character period. The counter 418 outputs CB0, CB1, CB2 and CB3 illustrated by FIG. 7(G) through (J), the digital code, which are loaded into the five-bit latch 420, after which counter 418 is cleared by CHPB. Loading of latch 420 is accomplished with CHPA pulses from flip-flop 402 via flip-flop 422, which is a part of the overall counter circuit 304 and has count CB4 shown by FIG. 7(K) coupled thereto. Thus, the output of counter 418, the data input to latch 420, also drives flip-flop 422, clocked by CHPA, the output of which is coupled to the D/A ladder network 308 of FIG. 4 together with outputs of latch 420, LB0, LB1, LB2 and LB3 illustrated by FIG. 7(L) through 7(O). Counter 418 is presettable to HOME status via the output of initialization D flip-flop 424, clocked at CHPA and having coupled to the data input thereof the HOME output of inverter 405 illustrated by FIG. 7(B) and coupling LB4 to the ladder.]

The analog output of resistance ladder 308 is applied as the positive input to a buffering operational amplifier 310. The output of amplifier 310, the control voltage for VCO 312, a 555 timer, varies the VCO 312 output HCK with carriage speed (HOME A through C pulse data).

Figure 8:
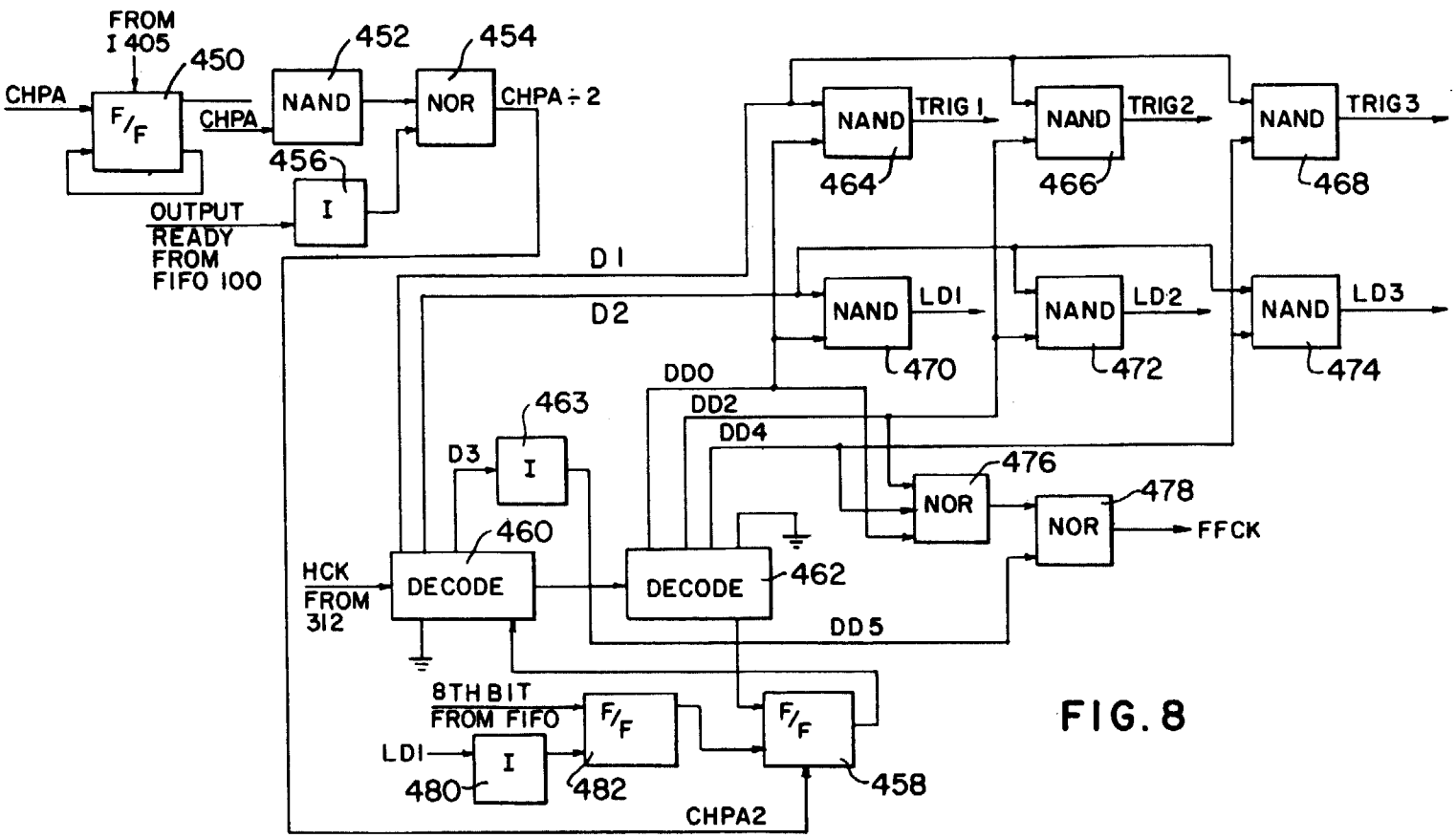
FIG. 8 is a schematic diagram of a timing circuit for generating certain of the waveforms described with respect to FIGS. 6 and 7.

Referring now to FIG. 8, the hammer timing circuit utilized for generating TRIG (1), TRIG (2) and TRIG (3) which initiate HAMMER DRIVE (1), HAMMER DRIVE (2) and HAMMER DRIVE (3) respectively; LD1, LD2 and LD3 which load the eight-bit hammer drive output registers 104, 106 and 108 with data from the FIFO register 100; and FFCK and disclosed. It is to be understood that the timing and synchronization circuitry of FIG. 8 is exemplary only, as many other timing circuit variations are possible once HCK is derived. The fundamental timing function is to load the hammer output registers with hammer data sequentially and is synchronized with the hammer drive.

The HOME output of inverter 405 which preloads latch 420 also serves as a reset signal for a D flip-flop 450 clocked by CHPA and having an output coupled to one input of a two-input NAND gate 452, the other NAND input being CHPA for generating a CHPA 2 output wave form which occurs every other CHPA and is reset to start the printing of a character by a printing head. The output of NAND 452 is NOR'ed by NOR gate 454 with the inverted OUTPUT READY pulse from FIFO 100 to insure that CHPA 2 is generated only when valid character data is present on the FIFO outputs. Inverting is accomplished by inverter 456. Print starting signal CHPA 2 is coupled from the output of NOR gate 454 to a D flip-flop 458. The illustrated timing removes the CLEAR from the output registers 104, 106 and 108, loading them with hammer firing data from the FIFO register 100. The three printing heads are fired sequentially; hence, three signals at the same frequency, but of different phase are provided.

The variable HCK from VCO 312 is coupled to a three-bit counter decoder 460 for generating three phased outputs: $D_1$ illustrated by FIG. 6(F), the second decoded count of HCK; $D_2$ illustrated by FIG. 6(G), the third decoded count of HCK; and $D_3$ illustrated by FIG. 6(H), the fourth decoded count of HCK. Further division of HCK is provided by another three-bit counter decoder 462 to derive HCk divided by eight and to provide DD0, DD2, DD4 and DD5 illustrated by FIGS. 6(I), 6(J), 6(K) and 6(L), respectively, and which signals are the first, third, fifth and sixth decoded counts of HCK divided by eight. The above described generated timing signals are used to fire the hammers each 1.3 milliseconds by providing a 10.2 microsecond divided by 64 "window" for hammer firing of 650 microseconds in three phases for triggering the three hammer banks. Print characters have dots in any given row only every other window. With three printing heads, the sequencing is as indicated by FIGS. 6(I) through 6(K). The phased trigger signals TRIG (1), TRIG (2) and TRIG (3) for initiating the hammer drives for heads one, two and three, respectively, shown by FIG. 3, are derived by combining $D_1$ and DD0 and NAND gate 464 to derive TRIG (1); $D_1$ and DD2 at NAND gate 446 to derive TRIG (2); and $D_1$ and DD4 at NAND gate 468 to derive TRIG (3). The phased loading signals LD1, LD2 and LD3 for loading data from FIFO to the hammer drive output registers for each head are derived by combining D2 and DD0 at NAND gate 470 to derive LD1; D2 and DD2 at NAND gate 472 to derive LD2; and D2 and DD4 at NAND gate 474 to derive LD3. The FIFO clock FFCK is derived by combining DD0, DD2 and DD4 at NOR gate 476, the output of which NOR gate is applied as one input to a two-input NOR gate 478; the other input thereto being DD5. The output of NOR gate 478 is FFCK. Loading signal LD1 after inverting by inverter 480 is used to clock the eighth bit from FIFO 100, a signal stored which is indicative of an end of character, through flip-flop 482, the output of which is applied to flip-flop 458 to enable the three bit decoders 460 and 462 to be reset by he output of flip-flop 458.

While the invention has been shown and described with reference to a preferred embodiment thereof, it will be understood that persons skilled in the art may make modifications thereto without departing from the spirit and scope of the invention as defined by the claims appended hereto.

What is claimed is:

1. A circuit for generating a variable frequency clock for use with a moving member comprising:

means for generating an input data signal representing alphanumeric character information, said data signal having a variable pulse-repetition frequency varying directly in accordance with the speed of the moving member;

means receiving said input data signal and for generating an output signal at a frequency corresponding to the frequencies of the received input data signal;

a reference oscillator having a pulsed output frequency greater than the pulse repetition frequency of said input data signal;

means for deriving a digital code from said reference oscillator indicative of said pulse repetition frequency in accordance with the output signal of said receiving means;

means for converting said digital code to an analog signal;

voltage controlled oscillator means having a control voltage derived from said analog signal coupled thereto and an output comprising said variable frequency clock; and means for synchronizing said input data signal with said variable frequency clock.

2. A circuit for generating a variable frequency clock in accordance with claim 1 wherein said receiving means comprises a digital filter for receiving digital alphanumeric character data and for generating an output at a frequency corresponding to the frequency at which said character data is received.

3. A circuit for generating a variable frequency clock in accordance with claim 2 wherein said means for deriving a digital code comprises a counter for counting the output pulses of said reference oscillator for a time duration corresponding to the output signal of said receiving means.

4. A circuit for generating a variable frequency clock in accordance with claim 3 further comprising:

a latch circuit for storing the count of said counter and for coupling said count as said digital code to said digital to analog means.

5. A circuit for generating a variable frequency clock in accordance with claim 4 wherein the output of said digital filter comprises a first signal for resetting said counter and a second signal for loading said latch with said counter output.

6. A circuit for generating a variable frequency clock in accordance with claim 5 further comprising:

timing signal generation means for dividing said variable clock output to obtain a plurality of sequential timing signals of like frequency and different phase.

7. In a matrix printer having at least a single printing head having a plurality of solenoid driven printing hammers selectively energizable in accordance with character data signals for printing matrix characters at a repetition rate which is variable in accordance with the speed at which the printing head is moved across a printing medium for maintaining the printing of substantially constant width characters:

means for generating character data signals having a pulse repetition rate corresponding to the speed of movement of said printing head;

means for deriving a pulsed digital signal from said character data signals having a pulse repetition rate corresponding to the speed of movement of said printing head;

means for deriving a digital code representative of said pulse repetition rate;

digital to analog conversion means for converting said digital code to an analog voltage;

voltage controlled oscillator means controlled by said analog voltage for generating a variable frequency clock; and synchronization means clocked by said variable frequency clock for causing said printing hammers to be energized to print said dot matrix characters at a rate proportional to the speed of movement of the printing head across the printing medium.

8. In a matrix printer in accordance with claim 7 wherein said means for deriving a pulsed digital signal comprises a digital filter.

9. In a matrix printer in accordance with claim 8 wherein said means for deriving a digital code comprises:

a reference oscillator for generating a master clock at a frequency greater than the frequency derived from said digital filter; and counter means for counting said master clock over a period of time corresponding to said pulsed digital signal derived from said digital filter.

10. In a matrix printer in accordance with claim 9 further comprising:

means for storing said derived digital code prior to the conversion of said digital code to an analog voltage.

11. In a matrix printer in accordance with claim 10 wherein said means for storing said derived digital code comprises a latching register.

12. In a matrix printer in accordance with claim 11 wherein the pulsed digital signal derived from said digital filter includes a reset signal for resetting said counter and a load signal for loading said latch with the output of said counter.

13. In a matrix printer in accordance with claim 9 wherein said digital to analog conversion means comprises a resistive ladder network for generating $(2)^N$ different analog outputs corresponding to an N-bit input.

14. In a matrix printer in accordance with claim 9 wherein said synchronizing means comprises:

an output latching register to which said character data signals are coupled; and timing signal generation means for deriving a load signal from said variable frequency clock for loading said output register with character data for selectively energizing said solenoids with an energizing voltage.

15. In a matrix printer in accordance with claim 9 wherein said synchronizing means comprises:

a plurality of output latching registers to which said character data signals are coupled, each output register corresponding to a printing head; and timing signal generation means for dividing said variable frequency clock to derive a plurality of sequential load signals of like frequency and different phase for respectively loading said plurality of output registers with said character data for selectively energizing said solenoids with an energizing voltage.

16. In a matrix printer for printing matrix characters by incrementing at least one printing head containing one or more print hammers across a printing medium at varying speeds of movement, a hammer repetition rate control for varying the hammer repetition rate proportional to said printing head varying speed for maintaining constant width characters, comprising:

a source of digital character data having a pulse-repetition frequency varying directly with the speed of movement of the printing head;

means for deriving a signal having a pulse repetition frequency corresponding to the time period of said character data;

means for deriving a multi-bit digital code representative of said character time period;

digital to analog conversion means for converting said multi-bit code to an analog voltage;

voltage controlled oscillator means controlled by said analog voltage for generating a variable frequency clock;

output data register means;

buffer means synchronized by said variable frequency clock for coupling said character data from said character data source to said output data register means; and means controlled by said buffer means for energizing said one or more print hammers such that said hammer repetition rate is proportional to said printing head speed of movement.

17. In a matrix printer in accordance with claim 16, a hammer repetition rate control wherein said multi-bit code is a five-bit code.

18. In a matrix printer in accordance with claim 16, a hammer repetition rate control wherein said source of digital character data is a data bus from a controller.

19. In a matrix printer in accordance with claim 18, a hammer repetition rate control wherein said data bus is an eight-bit wide parallel data bus.

20. In a matrix printer in accordance with claim 16, a hammer repetition rate control wherein said means for deriving a signal having a pulse repetition frequency corresponding to the time period of said characters dots comprises a digital filter.

21. In a matrix printer in accordance with claim 20, a hammer repetition rate control wherein said means for deriving a multi-bit digital code comprises:

a reference oscillator for generating a master clock; and a counter for counting said master clock over said character time period.

22. In a matrix printer in accordance with claim 21, a hammer repeition rate control further comprising:

a latching register for storing said multi-bit digital code prior to the conversion of said code to an analog voltage; and wherein the signal derived by said digital filter includes a reset signal for resetting said counter and a load signal for loading the counter output into said latching register.

23. In a matrix printer in accordance with claim 16, a hammer repetition rate control wherein said output data register is a latching register.

24. In a matrix printer in accordance with claim 24, a hammer repetition rate control wherein said buffer means comprises a first-in-first-out register, said hammer repetition rate control further comprising:

frequency divider means for dividing said variable frequency clock into a plurality of timing signals for loading said character data into said output register from said first-in-first-out register and for enabling said means for energizing said one or more print hammers.

* * * * *

UNITED STATES PATENT OFFICE

CERTIFICATE OF CORRECTION

Patent No. 4,020,939 Dated May 3, 1977

Inventor(s) Richard S. Quaif and John D. Hays

It is certified that error appears in the above-identified patent and that said Letters Patent are hereby corrected as shown below:

Claim 24, line 1, "24" should be -- 23 --.

Signed and Sealed this

*Twenty-second* Day of *November 1977*

[SEAL]

*Attest:*

RUTH C. MASON
*Attesting Officer*

LUTRELLE F. PARKER
*Acting Commissioner of Patents and Trademarks*